US006938346B1

(12) United States Patent
Huang

(10) Patent No.: US 6,938,346 B1
(45) Date of Patent: Sep. 6, 2005

(54) PAIR OF SCISSORS COMPRISING A GEAR TRANSMISSION MECHANISM TO WORK A MOVABLE JAW THEREOF

(75) Inventor: Chin-Chi Huang, Chang Hwa Hsien (TW)

(73) Assignee: Hong Chuan Hsian Industries Co., Ltd., Chang Hwa (TW)

( * ) Notice: Subject to any disclaimer, the term of this patent is extended or adjusted under 35 U.S.C. 154(b) by 0 days.

(21) Appl. No.: 10/394,867

(22) Filed: Mar. 24, 2003

(51) Int. Cl.[7] ..... B26B 13/00

(52) U.S. Cl. ..... 30/250; 30/192; 30/245; 81/342

(58) Field of Search ..... 30/92, 186, 187, 30/188, 191, 192, 193, 244, 245, 248, 249, 250, 251, 252, 253, 254, 272.1; 81/342, 358

(56) References Cited

U.S. PATENT DOCUMENTS 3,210,844 A * 10/1965 Tontscheff ..... 30/250
4,378,636 A * 4/1983 Wick ..... 30/250 X
4,677,748 A * 7/1987 Kobayashi ..... 30/250
4,779,342 A * 10/1988 Kobayashi et al. ..... 30/250
5,184,404 A * 2/1993 Chen ..... 30/250
5,570,510 A * 11/1996 Linden ..... 30/250
5,987,754 A * 11/1999 Hirabayashi et al. ..... 30/228

* cited by examiner

*Primary Examiner*—Clark F. Dexter
(74) *Attorney, Agent, or Firm*—Charles E. Baxley

(57) ABSTRACT

A pair of scissors has a fixed handle, a fixed jaw extending from one end of the fixed handle, a movable jaw pivotable with respect to the fixed jaw, a movable handle pivoted with the fixed jaw along with the movable jaw by a common pivot, and a gear transmission mechanism. The gear transmission mechanism has a rack located at one end of the movable jaw, a drive gear rotatably mounted on the fixed jaw and engaged with the rack, and two driven gears rotatably mounted on the fixed jaw and engaged with the drive gear and the toothed edge of the movable jaw. The two driven gears are driven by the drive gear to cause the movable jaw to move toward or away from the fixed jaw.

1 Claim, 5 Drawing Sheets

PAIR OF SCISSORS COMPRISING A GEAR TRANSMISSION MECHANISM TO WORK A MOVABLE JAW THEREOF

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a pair of scissors, and more particularly to an energy-efficient pair of scissors comprising a gear transmission mechanism to work efficiently a movable jaw thereof.

BACKGROUND OF THE INVENTION

The conventional pair of scissors comprises a fixed handle, a movable handle pivoted with the fixed handle, a fixed jaw extending from one end of the fixed handle, and a movable jaw formed at one end of the movable handle. In operation, the movable jaw is directly actuated by the movable handle to move toward the fixed jaw so as to bring about the scissors action by which an object is cut by the cutting edges of the fixed jaw and the movable jaw. When the fixed jaw and the movable jaw are at work to cut the object, a reaction force is induced in response to the scissors action. As a result, a user of the conventional pair of scissors must make an additional effort to overcome the reaction force. In another words, the conventional pair of scissors is not efficient.

BRIEF SUMMARY OF THE INVENTION

The primary objective of the present invention is to provide a pair of scissors comprising a movable jaw which is indirectly actuated by a movable handle so as to enhance the working efficiency of the scissors.

The pair of scissors of the present invention comprises a fixed handle, a fixed jaw extending from one end of the fixed handle, a movable jaw pivoted with the fixed jaw, a movable handle pivoted with the fixed jaw along with the movable jaw, and a gear transmission mechanism by which the movable jaw is indirectly driven by the movable handle to bring about the scissors action in conjunction with the fixed jaw. In another words, the motion of the movable handle is transmitted to the movable jaw by the gear transmission mechanism.

The features and the advantages of the present invention will be more readily understood upon a thoughtful deliberation of the following detailed description of the present invention with reference to the accompanying drawings.

DETAILED DESCRIPTION OF THE INVENTION

Figure 1:
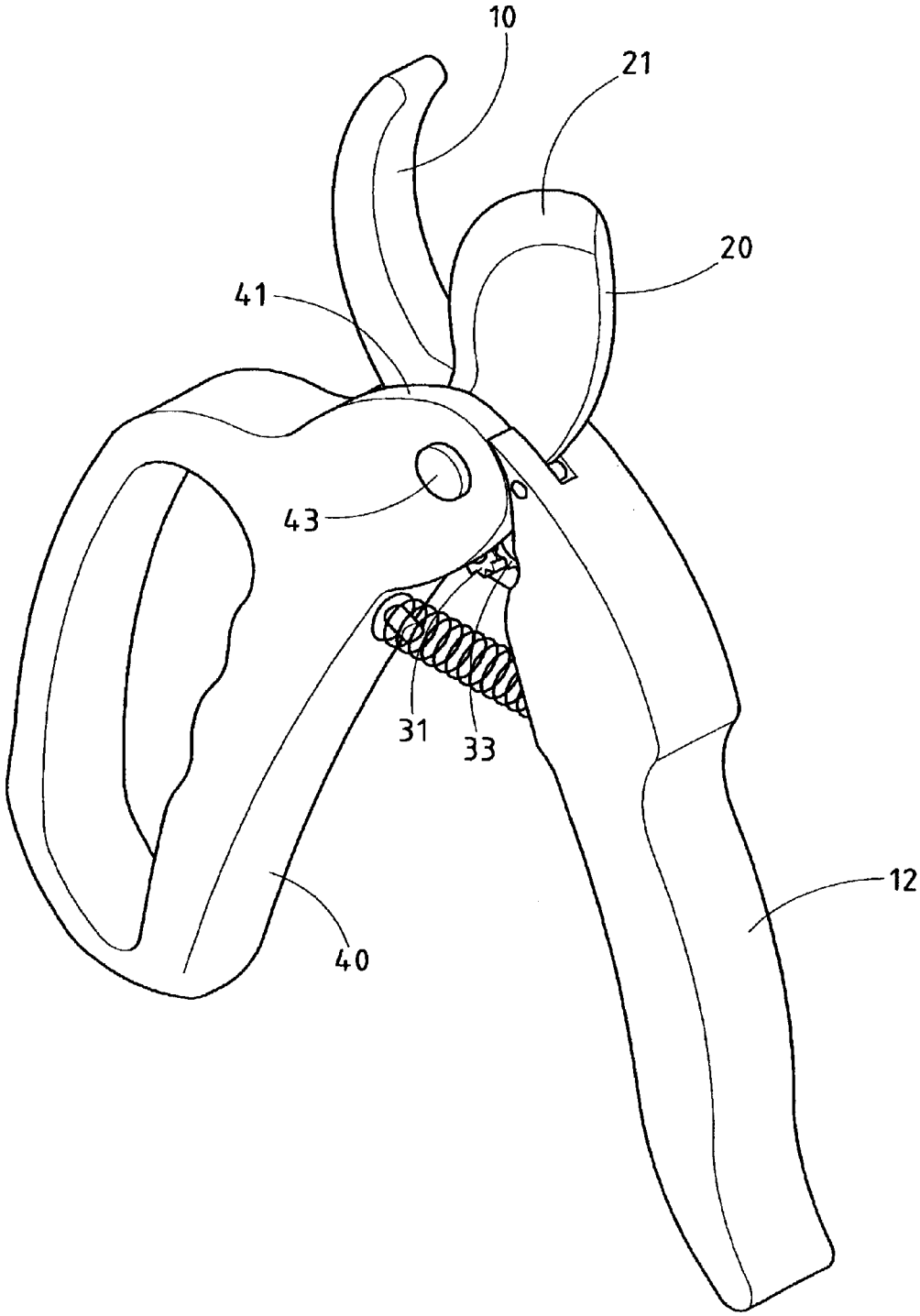
FIG. 1 shows a perspective view of the present invention.
Figure 2:
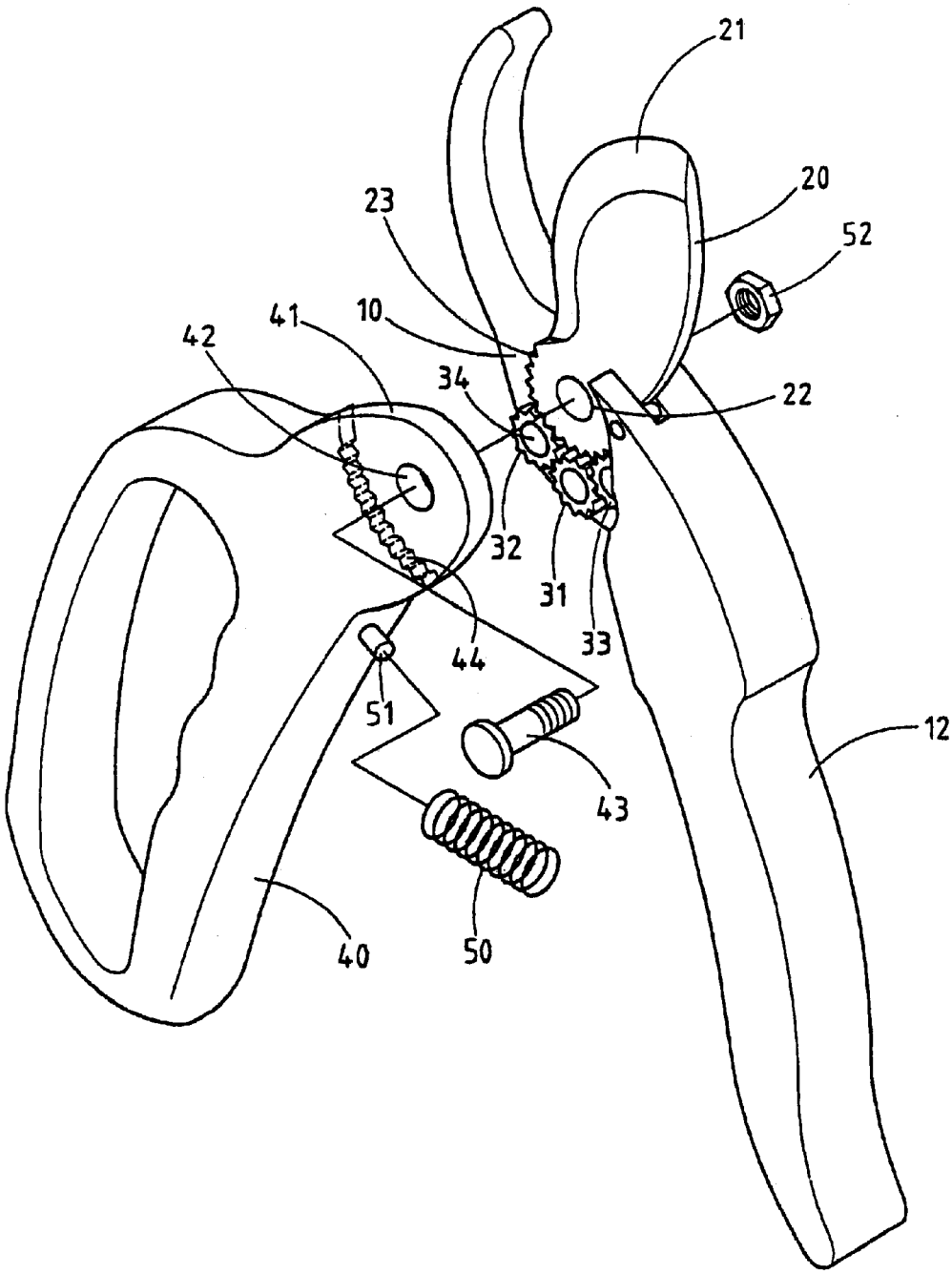
FIG. 2 shows a partially exploded perspective view of the present invention.

As shown in FIGS. 1–5, a pair of scissors of the present invention comprises a fixed jaw 10, a fixed handle 12, a movable jaw 20, a movable handle 40, and a gear transmission mechanism.

The fixed jaw 10 is extended from one end of the fixed handle 12 and is provided with a pivoting hole 13 which is located in proximity of the one end of the fixed handle 12.

Figure 3:
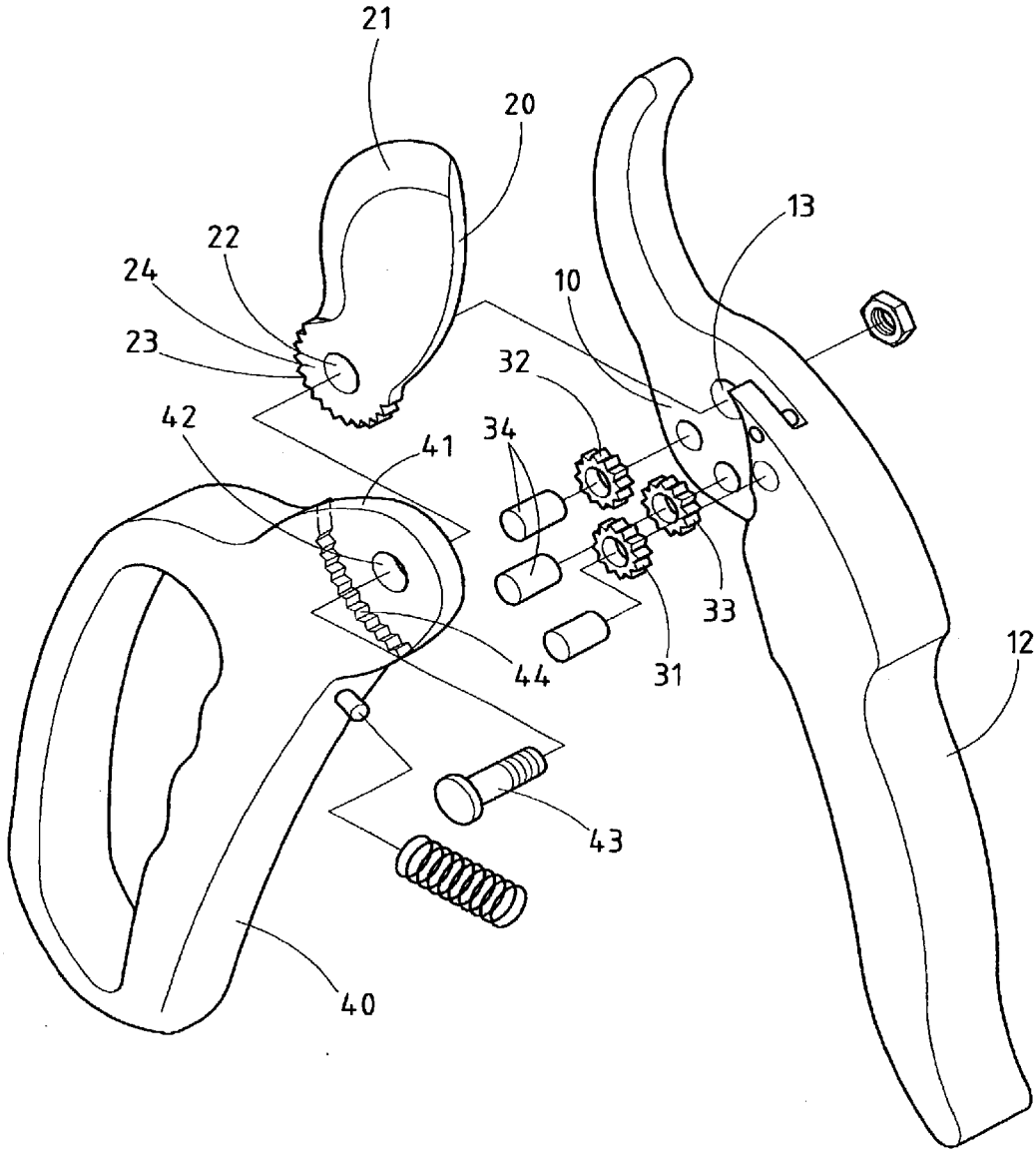
FIG. 3 shows a completely exploded perspective view of the present invention.

The movable jaw 20 has a cutting edge 21 and a pivoting end 24, as shown in FIG. 3. The pivoting end 24 is provided with a pivoting hole 22. The movable jaw 20 is pivoted with the fixed jaw 10 by a pivot 43 which is received in the pivoting hole 22 of the movable jaw 20 and the pivoting hole 13 of the fixed jaw 10.

The movable handle 40 has a pivoting end 41 which is provided with a pivoting hole 42. The movable handle 40 is pivoted with the fixed jaw 10 along with the movable jaw 20 by the pivot 43 which is received in the three pivoting holes 42, 22, and 13.

Figure 4:
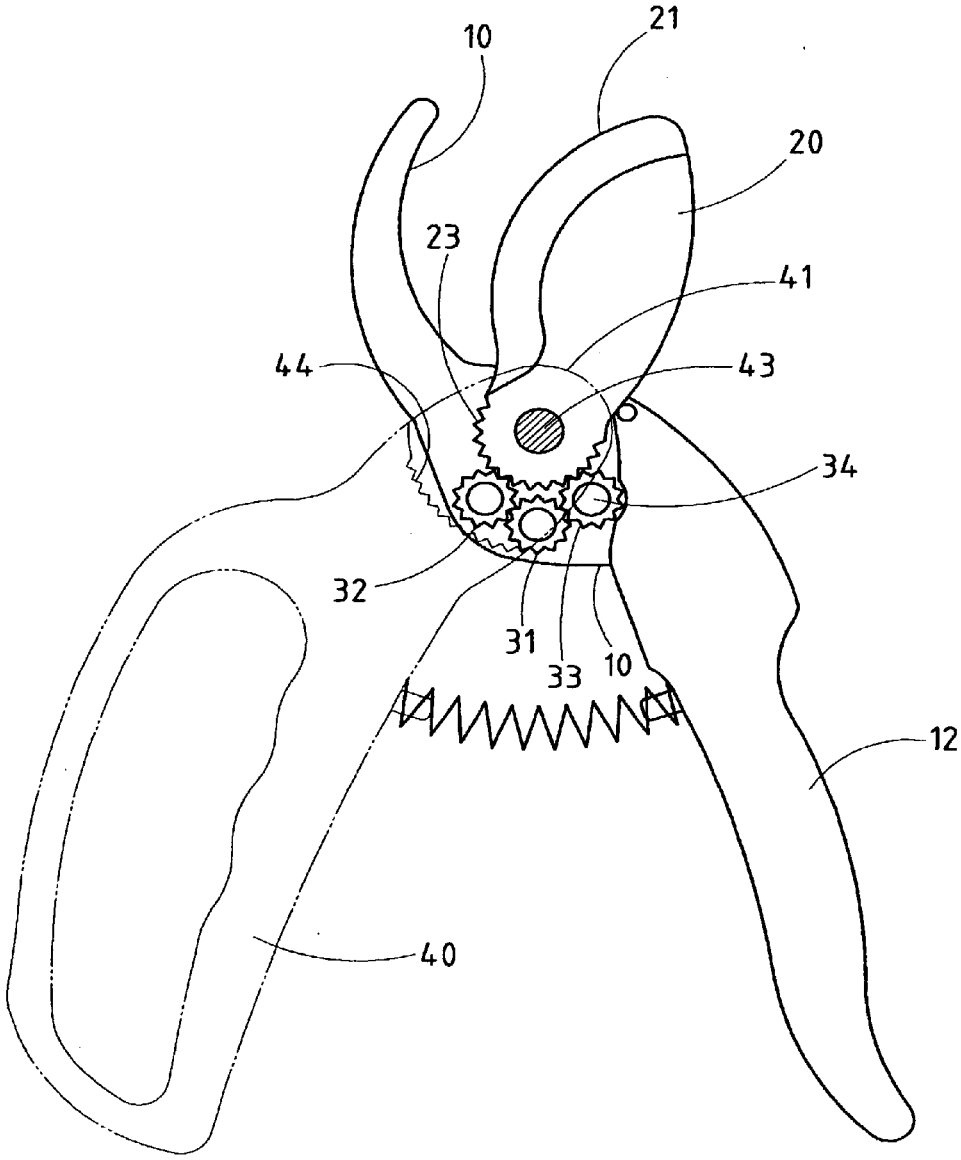
FIG. 4 is a schematic plan view to show that the present invention is not at work.
Figure 5:
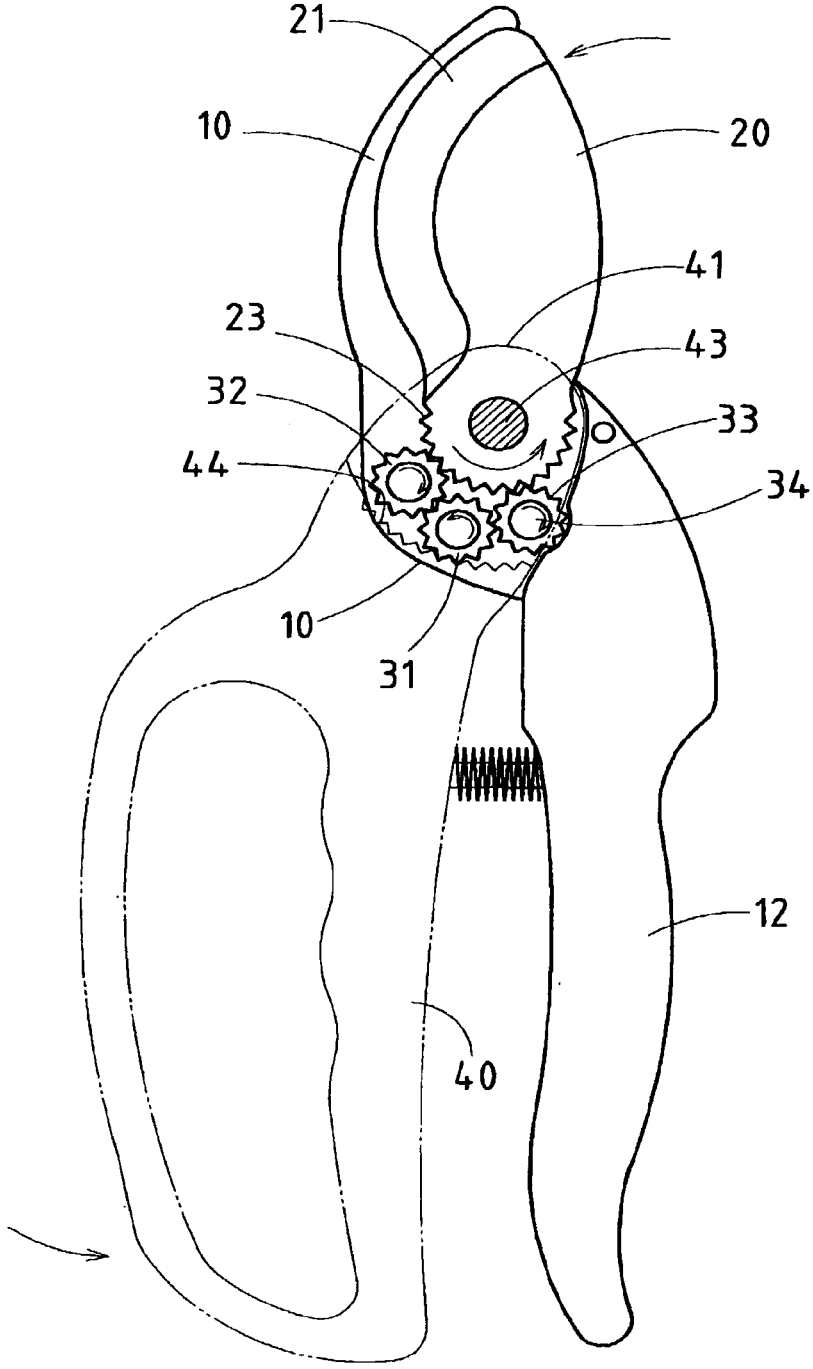
FIG. 5 is a schematic plan view to show that the present invention is in action.

The gear transmission mechanism comprises a semicircular toothed edge 23 located at the pivoting end 24 of the movable jaw 20, an arcuate rack 44 located at the pivoting end 41 of the movable handle 40, a drive gear 31 rotatable mounted on the fixed jaw 10 by a pivot 34 such that the drive gear 31 meshes with the rack 44 of the movable handle 40, and meshes with the two driven gears 32 and 33 which are respectively rotatable mounted with the fixed jaw 10 by pivots 34. The two driven gears 32 and 33 engage the drive gear 31 and the toothed edge 23 of the movable jaw 20, as shown in FIGS. 4 and 5. A spring 50 has one end affixed to stud 51 extending from movable handle 49 and urges against a surface of fixed handle 12. A nut 52 is secured threadedly to the pivot 43.

As the movable handle 40 is caused by an external force to move toward the fixed handle 12, the drive gear 31 is actuated to turn by the rack 44 of the movable handle 40 in counterclockwise direction, as shown in FIG. 5. In light of the two driven gears 32 and 33 being engaged with the drive gear 31 as well as the toothed edge 23 of the movable jaw 20, the two driven gears 32 and 33 are driven by the drive gear 31 to turn clockwise. Meanwhile, the toothed edge 23 of the movable jaw 20 is driven by the two driven gears 32 and 33 to turn counterclockwise, thereby causing the movable jaw 20 to move toward the fixed jaw 10 to bring about the scissors action by which an object is cut. As soon as the movable handle 40 is relieved of the external force exerting thereon, the transmission of motion described above works in reverse, thereby causing the toothed edge 23 of the movable jaw 20 to be driven in reverse by the two driven gears 32 and 33. As a result, the movable jaw 20 moves away from the fixed jaw 10.

The present invention described above is to be regarded in all respects as being illustrative and nonrestrictive. Accordingly, the present invention may be embodied in other specific forms without deviating from the spirit thereof The present invention is therefore to be limited only by the scope of the following claim.

I claim:

1. A pair of scissors comprising:

a fixed handle;

a fixed jaw extending from one end of said fixed handle and having a pivoting hole which is located in proximity of the one end of said fixed handle;

a movable jaw having a pivoting end with a pivoting hole formed therein, said movable jaw being pivotally connected to said fixed jaw by a pivot which extends through said pivoting hole of said movable jaw and through said pivoting hole of said fixed jaw;

a movable handle having a pivoting end with a pivoting hole formed therein, said movable handle being pivotally connected to said fixed jaw and said movable jaw by said pivot; and a gear transmission means for transmitting motion of said movable handle to drive said movable jaw toward or away from said fixed jaw, said gear transmission means comprising:

a toothed edge formed along said pivoting end of said movable jaw;

a rack formed at said pivoting end of said movable handle;

a drive gear rotatably mounted on said fixed jaw in such a manner that said drive gear meshes with said rack of said movable handle; and two driven gears respectively rotatably mounted to said fixed jaw such that said two driven gears are engaged with said drive gear and mesh with said toothed edge of said movable jaw, said two driven gears being driven by said drive gear to cause said movable jaw to move toward or away from said fixed jaw at the time when said drive gear is actuated by said rack of said movable handle.

* * * * *